US008147009B1

(12) United States Patent
Rider

(10) Patent No.: US 8,147,009 B1
(45) Date of Patent: Apr. 3, 2012

(54) CABINET COMPONENT SYSTEM

(76) Inventor: H. Joe Rider, Collinsville, OK (US)

( * ) Notice: Subject to any disclaimer, the term of this patent is extended or adjusted under 35 U.S.C. 154(b) by 373 days.

(21) Appl. No.: 12/628,580

(22) Filed: Dec. 1, 2009

Related U.S. Application Data

(63) Continuation-in-part of application No. 11/948,403, filed on Nov. 30, 2007, now abandoned.

(51) Int. Cl.
*A47B 47/00* (2006.01)

(52) U.S. Cl. ..... 312/257.1; 312/108; 312/111; 312/140.4; 52/79.1; 52/282.1

(58) Field of Classification Search ..... 312/257.1, 312/265.1, 265.2, 265.3, 265.4, 265.5, 100, 312/102, 107, 108, 111, 238, 263, 140.1, 312/140.3, 140.4; 403/169, 171, 176, 231; 52/79.1, 239, 250, 261, 270, 275, 282.1, 52/282.2, 284, 426, 562
See application file for complete search history.

(56) References Cited

U.S. PATENT DOCUMENTS

| | | | | | |
|---|---|---|---|---|---|
| 856,788 | A | * | 6/1907 | Levy | 5/623 |
| 1,008,813 | A | * | 11/1911 | Gloekler | 312/140.4 |
| 1,818,404 | A | | 8/1931 | Kaufman | |
| 2,812,225 | A | * | 11/1957 | Traxler | 312/140.3 |
| 2,956,705 | A | * | 10/1960 | Clingman | 220/683 |
| 3,362,739 | A | * | 1/1968 | Staeger et al. | 52/285.1 |
| 3,566,561 | A | | 3/1971 | Tozer | |
| 3,845,593 | A | | 11/1974 | Zen | |
| 3,998,509 | A | * | 12/1976 | Hauser | 312/263 |
| 4,045,104 | A | | 8/1977 | Peterson | |
| 4,192,562 | A | | 3/1980 | Bishoff et al. | |
| 4,279,455 | A | | 7/1981 | Santo | |
| 4,389,948 | A | | 6/1983 | Sands et al. | |
| 4,470,647 | A | * | 9/1984 | Bishoff et al. | 312/111 |
| 4,614,066 | A | | 9/1986 | Koppenberg | |
| 4,997,240 | A | | 3/1991 | Schmalzl et al. | |
| 5,395,442 | A | | 3/1995 | Dunton et al. | |
| 5,470,139 | A | * | 11/1995 | Hsiao | 312/140 |
| 5,598,790 | A | | 2/1997 | Fich | |
| 5,647,181 | A | | 7/1997 | Hunts | |
| 5,843,327 | A | | 12/1998 | Lindgren | |
| 5,974,762 | A | * | 11/1999 | Rodgers | 52/742.14 |
| 5,987,827 | A | | 11/1999 | Lord | |
| 6,115,982 | A | * | 9/2000 | Lindenberg | 52/506.05 |
| 6,540,201 | B1 | | 4/2003 | Gagnon et al. | |
| 6,637,353 | B2 | | 10/2003 | Alizade | |
| 6,718,709 | B2 | | 4/2004 | Koutras et al. | |
| 6,840,182 | B2 | | 1/2005 | Price | |
| 6,843,025 | B2 | | 1/2005 | Paz | |
| 7,048,346 | B2 | | 5/2006 | Saravis | |
| 7,055,918 | B2 | * | 6/2006 | LaChance et al. | 312/140.3 |

(Continued)

*Primary Examiner* — James O Hansen
(74) *Attorney, Agent, or Firm* — Molly D. McKay

(57) ABSTRACT

The present invention is a component system for constructing the framework for cabinets of the type that are employed when building an outdoor kitchen. The components system consists of specially designed brackets used in conjunction with lightweight concrete side panels to construct the forms for the cabinets. The brackets have channels that attach to the corner edges of the concrete side panels and hold the side panels in place so that the top edges of the panels are accessible for attachment of back splashes and back bars. Brackets with more than one channel have support rods connecting their channels and holding them in spaced apart arrangement. Once the forms are constructed, their exterior surfaces can be finished in a variety of ways. The counter tops, wiring, plumbing, appliances and doors for the cabinets can then be installed to complete the cabinets and kitchen.

8 Claims, 8 Drawing Sheets

U.S. PATENT DOCUMENTS 7,121,274 B2 10/2006 Wishart
7,204,060 B2 4/2007 Hunt
7,204,471 B2 4/2007 Pietrobon
7,472,969 B2 1/2009 Saravis
2008/0069632 A1 3/2008 Gosling et al.
2009/0108719 A1* 4/2009 Lilly ..... 312/140.3

* cited by examiner

CABINET COMPONENT SYSTEM

CROSS-REFERENCE TO RELATED APPLICATIONS

The present application is a continuation in part application of U.S. patent application Ser. No. 11/948,403 filed on Nov. 30, 2007 now abandoned for Cabinet Component System.

BACKGROUND OF THE INVENTION

1. Field of the Invention

The present invention relates to a component system for constructing cabinets, particularly cabinets of the type that are employed when building an outdoor kitchen, although their usage is not limited to outdoors. The components system consists of specially designed brackets that are used in conjunction with concrete side panels to construct the forms for the cabinets so that the upper and lower edges of the side panels are accessible. Once the forms are constructed, then the forms can be finished in a variety of ways by applying to the exterior surfaces of the forms stucco, decorative stone, bricks, etc.

2. Description of the Related Art

Currently outdoor cabinets and outdoor kitchens are constructed by first installing a form or framework for the cabinets and kitchens, then applying an exterior finish to the forms. The exterior finish may be stucco, decorative stone, bricks, or other similar masonry products.

The forms are the supporting framework and define the structure for the cabinets and kitchens. The forms are currently constructed in one of two ways.

The first way to construct the forms is to custom build the forms or framework of the cabinets and kitchen using metal studs to the homeowner's plans and to fit with the types of appliances that the homeowner intends to use. Cement boards are then attached to the metal studs with dry wall screws. The advantage of custom built forms is that they can be constructed so that they meet the homeowner's needs in terms of arrangement of cabinets and in terms of fitting with the appliances that the homeowner wishes to use. However, the disadvantages of custom built forms is that they are labor intensive to build, making installation take longer and be expensive so that custom built forms can be cost prohibitive for many homeowners.

The second way to construct the forms is to use prefabricated forms for the cabinets and kitchen. Like custom built forms, prefabricated forms are made from metal studs and concrete boards that are generally attached to the metal studs with dry wall screws. The advantages of prefabricated forms are that they can be installed quickly and are much less expensive to purchase and install than custom built form. However, prefabricated forms have certain drawbacks. One drawback to prefabricated forms is that they are constructed for use with one type of appliance or equipment which may not be the type of appliances or equipment that the homeowner would like to use. Also, it is impractical to try to customize the prefabricated forms because of the way that they are built. Because the prefabricated forms are constructed for use with a particular type or brand of appliances, the openings that are provided in the prefabricated forms will generally not fit different brands of appliances. And because the forms are constructed with metal studs, it is impractical to cut new openings in the forms as this would require different types of cutting equipment to cut both metal studs and cement boards. Also, even if the forms could be cut easily, any cutting on the forms could result in damaging to the structural integrity of the forms.

The present invention addresses these problems by providing a new cabinet component system for building cabinet and kitchen forms. The present cabinet component system employs a variety of brackets and lightweight cement side panels that can be arranged in various ways to construct the form arrangement desired by the homeowner. Further the forms can be quickly and easily built at relatively low cost. When built, the forms are strong and can be readily customized on site for use with virtually any type of appliance or equipment. Thus, the present invention allows the homeowner to have customized forms with the convenience of prefabricated cost with increased ease and speed of installation.

SUMMARY OF THE INVENTION

The present invention is a component system for constructing the framework for cabinets, particularly cabinets of the type that are employed when building an outdoor kitchen. The components system consists of a variety of specially designed brackets that are used in conjunction with lightweight concrete side panels to construct a variety of different shaped forms for the cabinets so that the upper and lower edges of the side panels are accessible. The brackets have one or more channels that attach to the edges of the concrete side panels and hold the side panels in place. Brackets with more than one channel have support rods connecting their channels. Once the forms are constructed, then the forms can be finished in a variety of ways by applying a finish to the exterior surfaces such as stucco, decorative stone, bricks, etc. employing standard masonry techniques. The counter tops, wiring, plumbing, appliances and doors for the cabinets can then be installed to complete the cabinets and kitchen.

DETAILED DESCRIPTION OF THE PREFERRED EMBODIMENT

Figure 1:
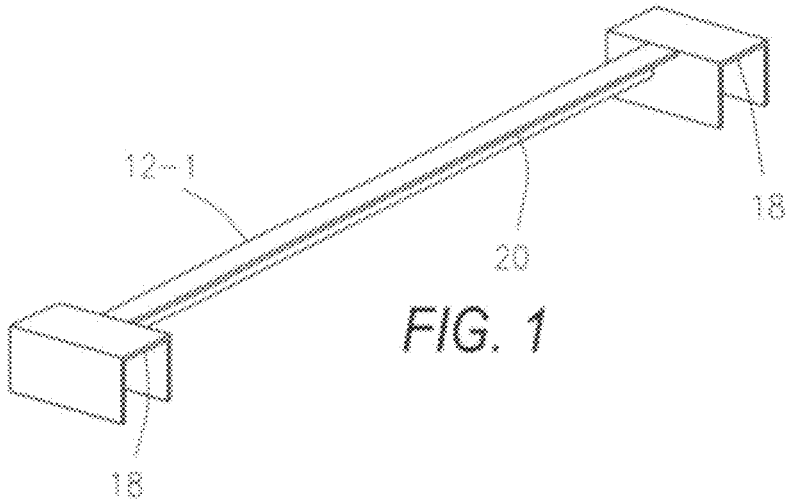
FIG. 1 is a perspective view of a horizontal first bracket used in the cabinet component system according to a preferred method of the invention to connect together cement side panels to form a 180 degree straight section of a cabinet form.
Figure 2:
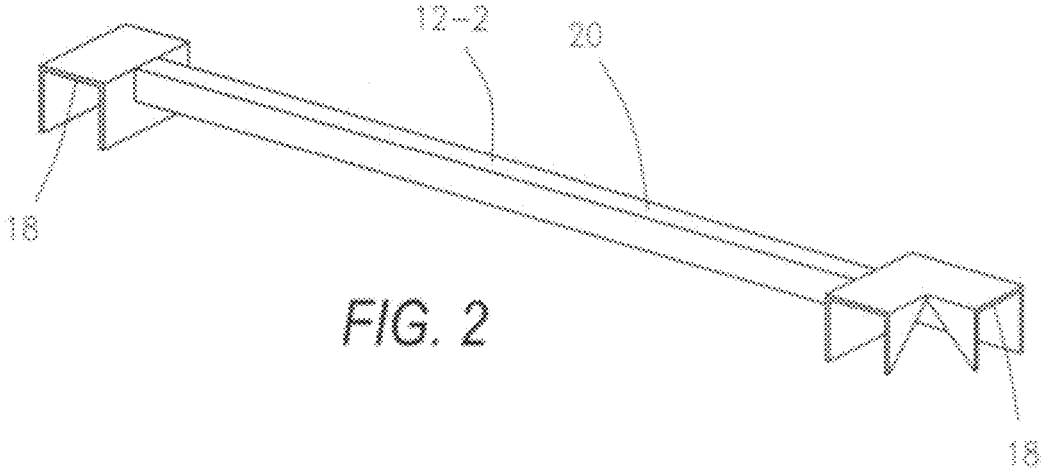
FIG. 2 is a perspective view of a horizontal second bracket used in the cabinet component system to connect together cement side panels to form a 90 degree angle inside corner section cabinet form.
Figure 3:
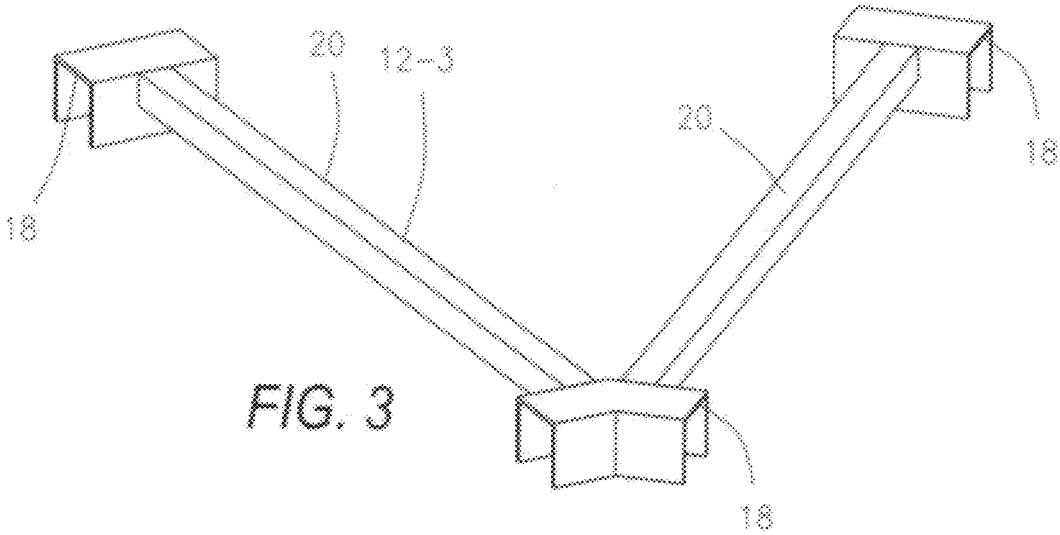
FIG. 3 is a perspective view of a horizontal third bracket used in the cabinet component system to connect together cement side panels to form a 135 degree angle inside corner section cabinet form.
Figure 4:
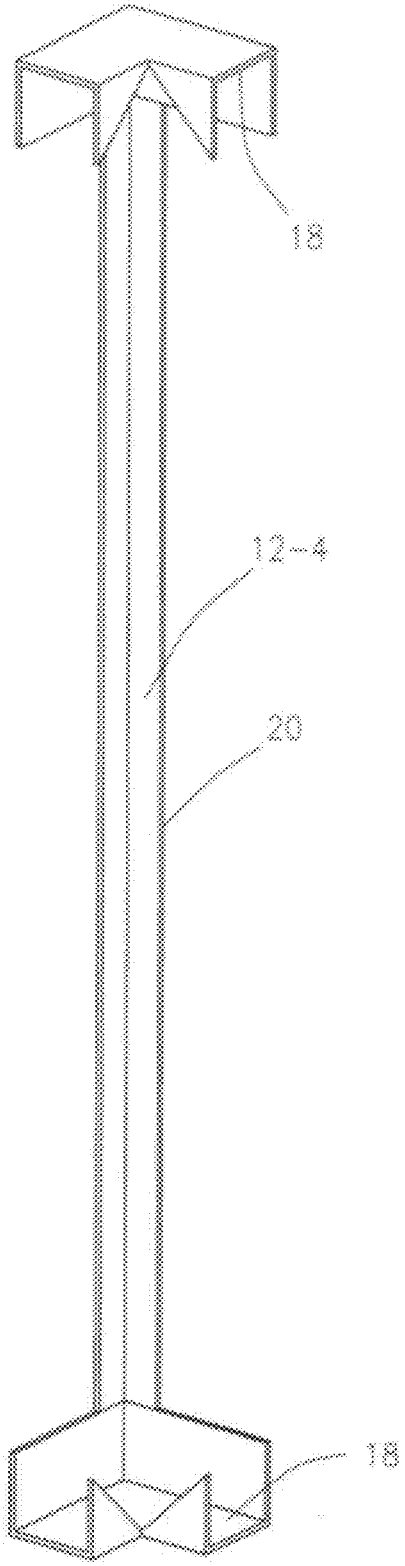
FIG. 4 is a perspective view of a vertical fourth bracket used in the cabinet component system to connect together cement side panels to form a 90 degree outside corner section cabinet form.
Figure 5:
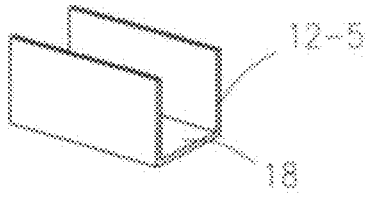
FIG. 5 is a perspective view of a horizontal fifth bracket used in the cabinet component system to connect together cement side panels to form a 180 degree straight section of a cabinet form.
Figure 6:
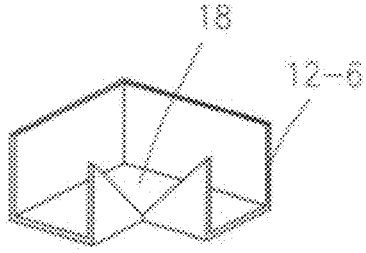
FIG. 6 is a perspective view of a horizontal sixth bracket used in the cabinet component system to connect together cement side panels to form a 90 degree instead corner section of a cabinet form.
Figure 7:
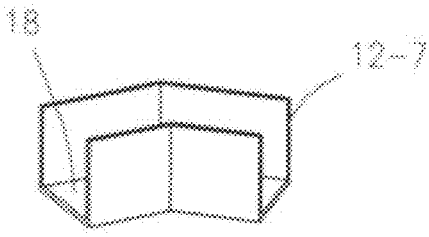
FIG. 7 is a perspective view of a horizontal seventh bracket used in the cabinet component system to connect together cement side panels to form a 135 degree outside corner section of a cabinet form.

Referring now to the drawings and initially to FIGS. 8-15, the present invention is a component system for constructing the framework or forms 10A, 10B, 10C, etc. for cabinets 11A, 11B, 11C, etc., particularly cabinets of the type that are employed when building an outdoor kitchen. The forms 10A, 10B, 10C, etc. are created so that the upper and lower edges of the side panels are accessible and are not covered by brackets 12 or support or connecting rods 20 that hold the brackets 12 in spaced apart arrangement. This accessibility to the upper edges of the side panels allows accessories such as for example a back splash unit 13A or a back bar unit 13B to be added to the cabinets, as will be more fully described hereafter. Although only three styles of cabinets 11A, 11B and 11C are illustrated, the invention is not so limited and any variety of cabinet shapes can be constructed employing the present invention.

Figure 9:
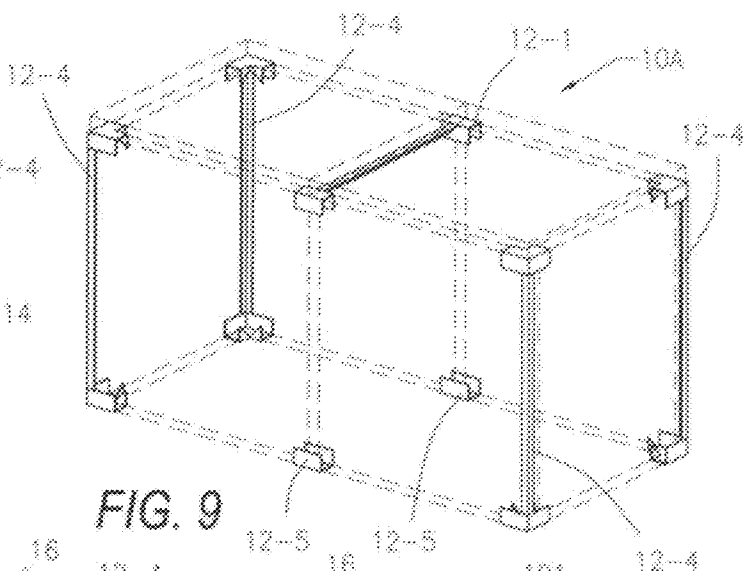
FIG. 9 is a perspective view of the rectangular cabinet form of FIG. 8 shown with the cement side panels and counter tops indicated in outline and with the first, fourth and fifth brackets in solid lines.
Figure 8:
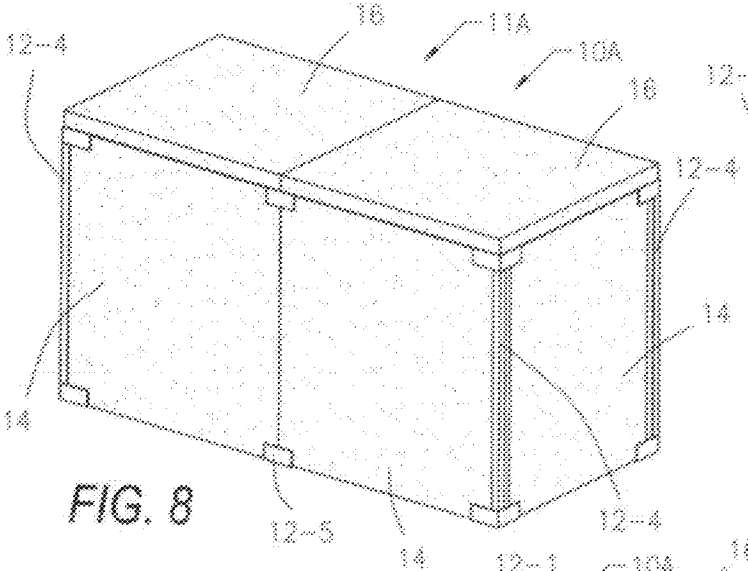
FIG. 8 is a perspective view of a rectangular cabinet form constructed from cement side panels and the first, fourth and fifth brackets shown with counter tops placed on top of the form.
Figure 11:
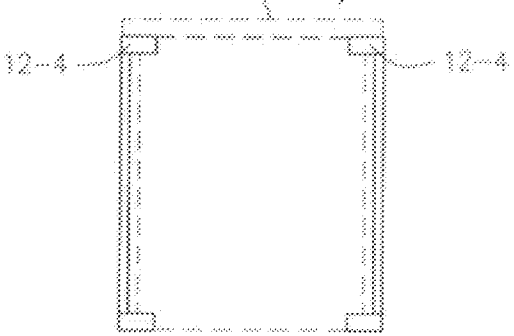
FIG. 11 is an end view of the rectangular cabinet form of FIG. 9.
Figure 10:
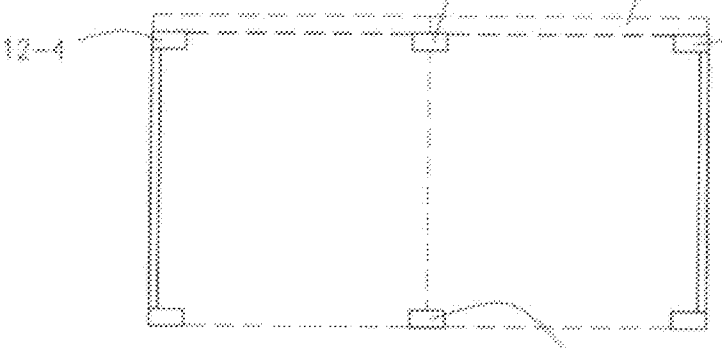
FIG. 10 is a side view of the rectangular cabinet form of FIG. 9.
Figure 12:
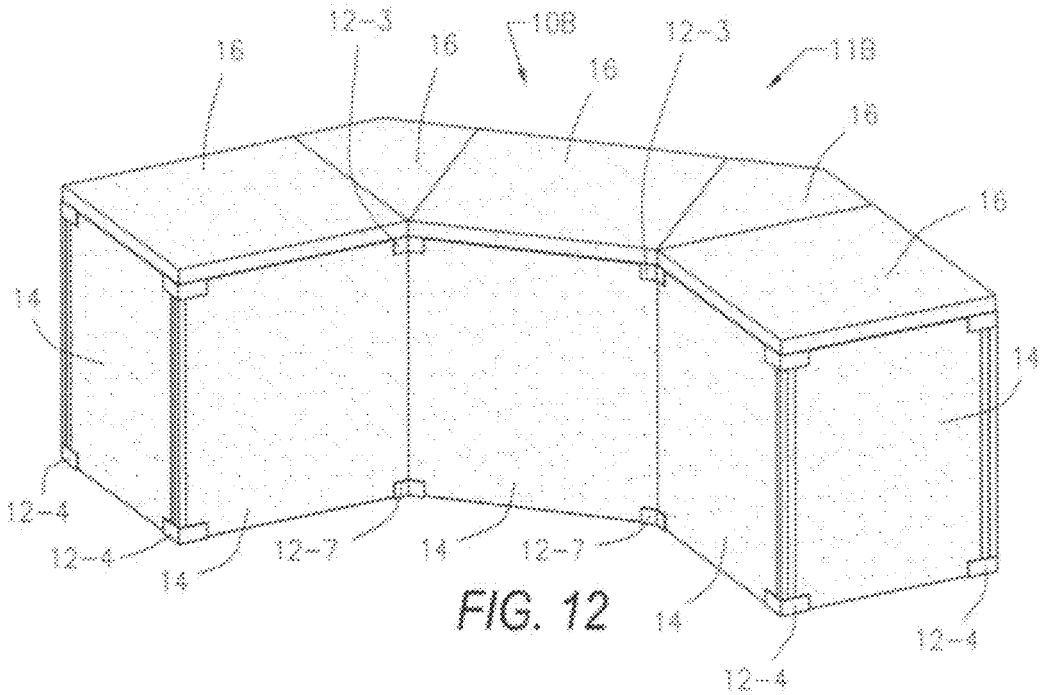
FIG. 12 is a perspective view of a double 135 degree angle cabinet form constructed from cement side panels and the third, fourth and seventh brackets shown with counter tops placed on top of the form.
Figure 13:
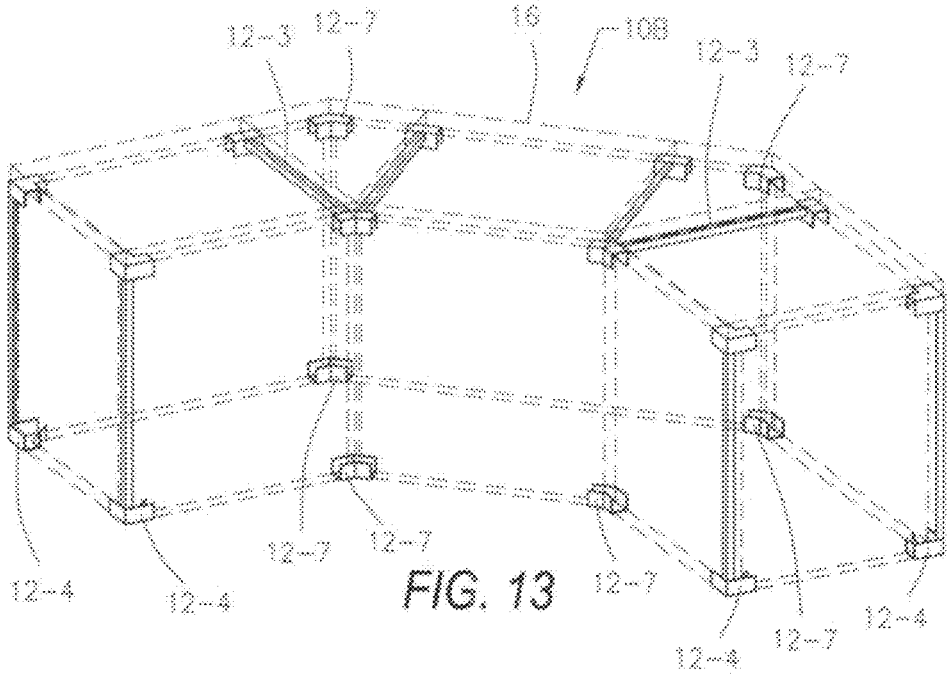
FIG. 13 is a perspective view of the double 135 degree angle cabinet form of FIG. 12 shown with the cement side panels and countertops indicated in outline and with the third, fourth and seventh brackets in solid lines.
Figure 14:
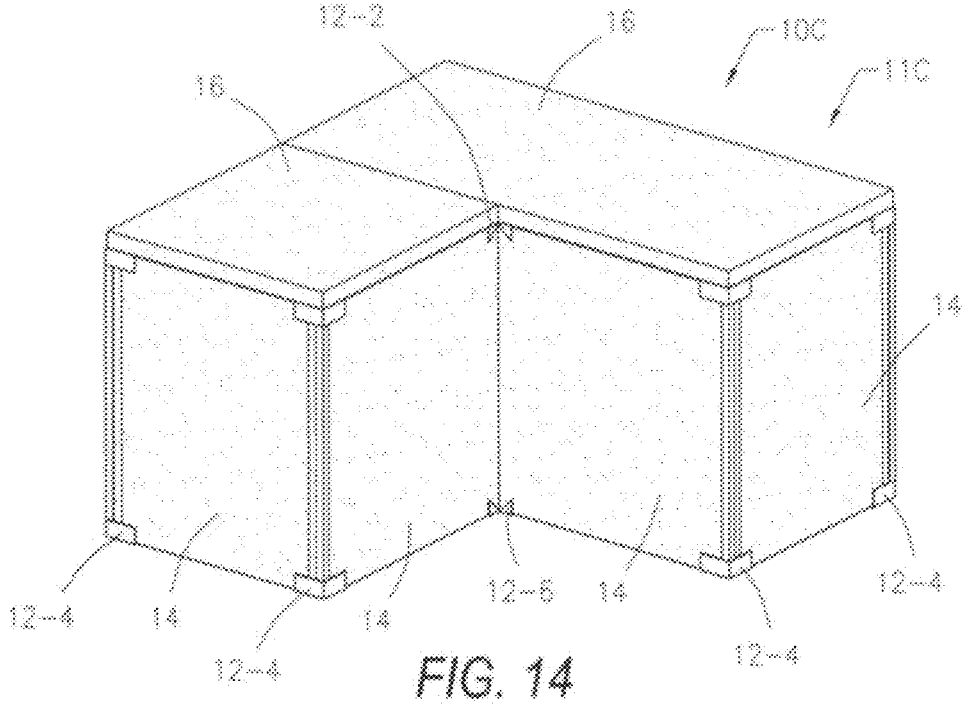
FIG. 14 is a perspective view of a 90 degree angle cabinet form constructed from cement side panels and the second, fourth and sixth brackets shown with counter tops placed on top of the form.
Figure 15:
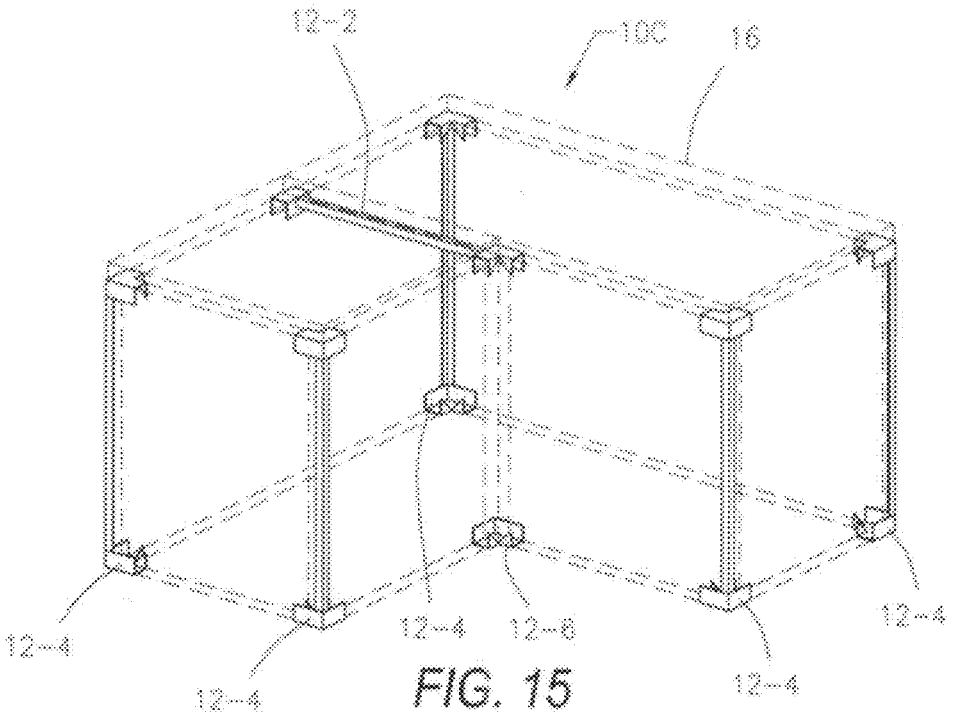
FIG. 15 is a perspective view of the 90 degree angle cabinet form of FIG. 14 shown with the cement side panels and countertops indicated in outline and with the second, fourth and sixth brackets in solid lines.

As illustrated in FIGS. 1-7, the components system consists of specially designed brackets 12-1, 12-2, 12-3, 12-4, 12-5, 12-6, 12-7, etc. that are used in conjunction with lightweight concrete side panels 14 to construct the forms 10A, 10B, 10C, etc. that are illustrated in FIGS. 9, 13, and 15 respectively for the cabinets 11A, 11B, 11C, etc, which are illustrated in FIGS. 8, 12, and 14 respectively. The concrete side panels 14 are attached together by the brackets 12-1, 12-2, 12-3, 12-4, 12-5, 12-6, 12-7, etc. which attach to the edges of the side panels. Each bracket 12-1, 12-2, 12-3, 12-4, 12-5, 12-6, 12-7, etc. is provided with one or more channels 18 for receiving the edge of one or more side panels 14 to thereby hold them in place. As shown in the drawings, the channels 18 may be straight, may form 90 degree angles or may form 135 degree angles. For those brackets 12-1, 12-2, 12-3 and 12-4 that have more than one channel 18, one or more support rods 20 attach to the channels 18 and hold the channels in spaced apart arrangement.

Lightweight concrete side panels 14 are preformed from a mixture of cement, water and light weight aggregate. A mixture of approximately 1 part dry cement and 1 part water to 4 parts light weight aggregate is generally found to be a suitable formulation for creating the side panels 14. Although various types of cement can be used, Portland cement is preferred. Also, although a variety of light weight aggregates can be used. Expanded shale which is clay that has been heated and\or perlite are preferred types of aggregates for making the mixture. Once the mixture has been thoroughly mixed, it is then poured into moulds to form the desired panel shapes and allowed to harden and cure. The side panels formed from this mixture are strong, but can be drilled or sawed to make desired openings therein.

Referring now to FIGS. 8-11, there is illustrated a rectangular cabinet form 10A that has been constructed from cement side panels 14 using the first, fourth and fifth brackets, 12-1, 12-4, and 12-5 respectively. This rectangular cabinet 10A is shown with counter tops 16 installed on top of the form 10A.

Now referring to FIGS. 12 and 13, there is illustrated a double 135 degree angle cabinet form 10B that has been constructed from cement side panels 14 and the third, fourth and seventh brackets, 12-3, 12-4 and 12-7 respectively. This double 135 degree angle cabinet form 10B is shown with counter tops 16 installed on top of the form 10B. Although the counter tops 16 are shown in multiple pieces in the drawings, it should be understood that they need not be segmented and may be constructed in one or multiple pieces. Typical materials from which the counter tops might be made are granite, marble, tile, etc.

Referring to FIGS. 14 and 15, there is illustrated a 90 degree angle cabinet form 10C that has been constructed from cement side panels 14 and the second, fourth and sixth brackets 12-2, 12-4 and 12-6. This 90 degree angle cabinet form 10C is shown with counter tops 16 installed on top of the form 10C.

Although only three forms 10A, 10B and 10C are illustrated, it is obvious that many other configurations of forms (not illustrated) could be constructed with cement side panels 14 and the brackets 12-1, 12-2, 12-3, 12-4, 12-5, 12-6, 12-7, etc.

Also, although only seven types of brackets 12-1, 12-2, 12-3, 12-4, 12-5, 12-6, 12-7 are illustrated, the invention is not so limited and other angles of brackets could be constructed in order to create still other configurations of forms. The important thing is that the brackets 12-1, 12-2, 12-3, 12-4, 12-5, 12-6, 12-7, etc. engage the edges of the cement side panels 14 to hold them in place. This edge placement of the brackets 12-1, 12-2, 12-3, 12-4, 12-5, 12-6, 12-7, etc. allows the installer to cut the size and shape of openings in the cement side panels 14 that are desired without interfering with the brackets 12-1, 12-2, 12-3, 12-4, 12-5, 12-6, 12-7, etc. and thus without compromising the structural integrity of the forms 10A, 10B, 10C, etc.

Once the forms 10A, 10B, 10C, etc. are constructed, then the forms 10A, 10B, 10C, etc. can be finished in a variety of ways by applying a finish to the exterior surfaces of the concrete side panels 14 such as stucco, decorative stone, bricks, etc. (not illustrated) employing standard masonry techniques. Counter tops 16 can be added to the top of the forms 10A, 10B, 10C, etc. and, wiring, plumbing, appliances and doors for the forms 10A, 10B, 10C, etc. can then be installed to complete the cabinets 11A, 11B, 11C, etc. and kitchen.

As previously described, the forms 10A, 10B, 10C, etc. are created so that the upper and lower edges of the side panels 14 are accessible and are not covered by the brackets 12 or the support or connecting rods 20 that hold the brackets 12 in spaced apart arrangement. This accessibility to the upper edges of the side panels 14 allows accessories such as a back splash unit 13A or a back bar unit 13B to be added to the cabinets 11A, 11B, 11C, etc.

Figure 16:
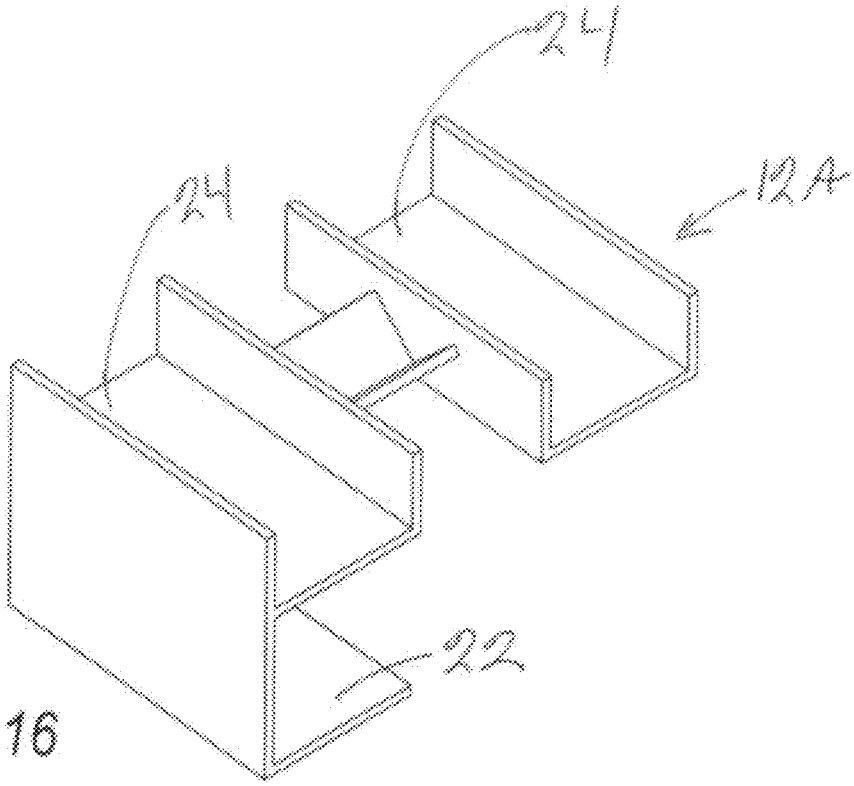
FIG. 16 is an enlarged perspective view of an accessory bracket.
Figure 17:
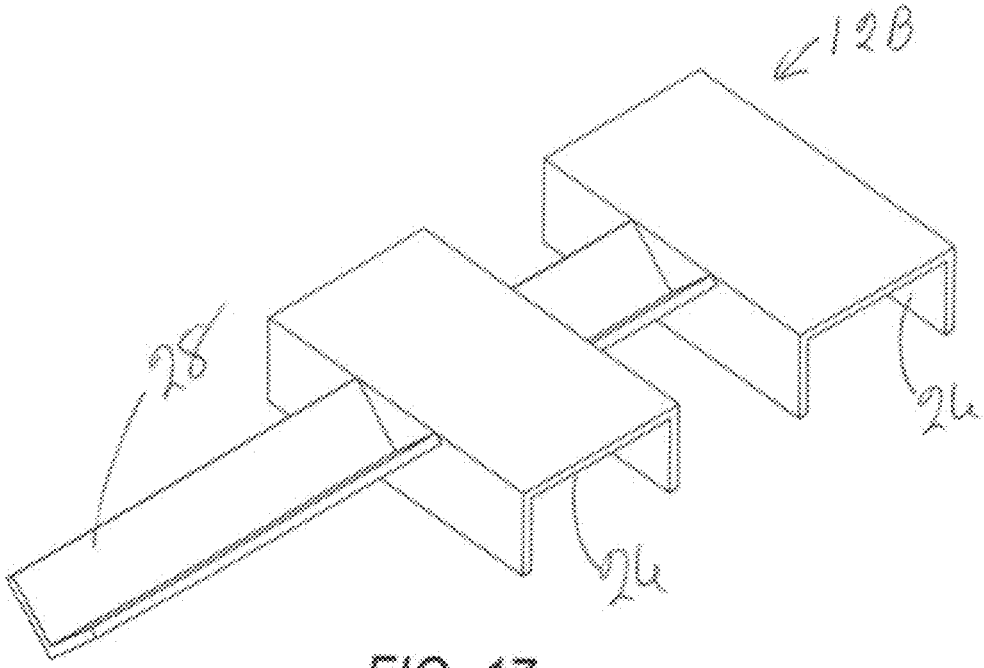
FIG. 17 is an enlarged perspective view of a back bar bracket.

Referring now to FIGS. 16-21, the addition of a couple of back splash units 13A and a couple of back bar units 13B to a rectangular cabinet form 10A is illustrated. For convenience in installing electrical wiring, it is desirable to cut necessary electrical holes (not illustrated) in the back splash or back bar risers 15 prior to installation. The accessory bracket 12A that is used to secure both of these accessories 13A and 13B to the cabinet form 10A is illustrated in FIG. 16. The back bar bracket 12B that supports the top 16B of the back bar 13B on the back bar risers 15 is illustrated in FIG. 17.

Figure 18:
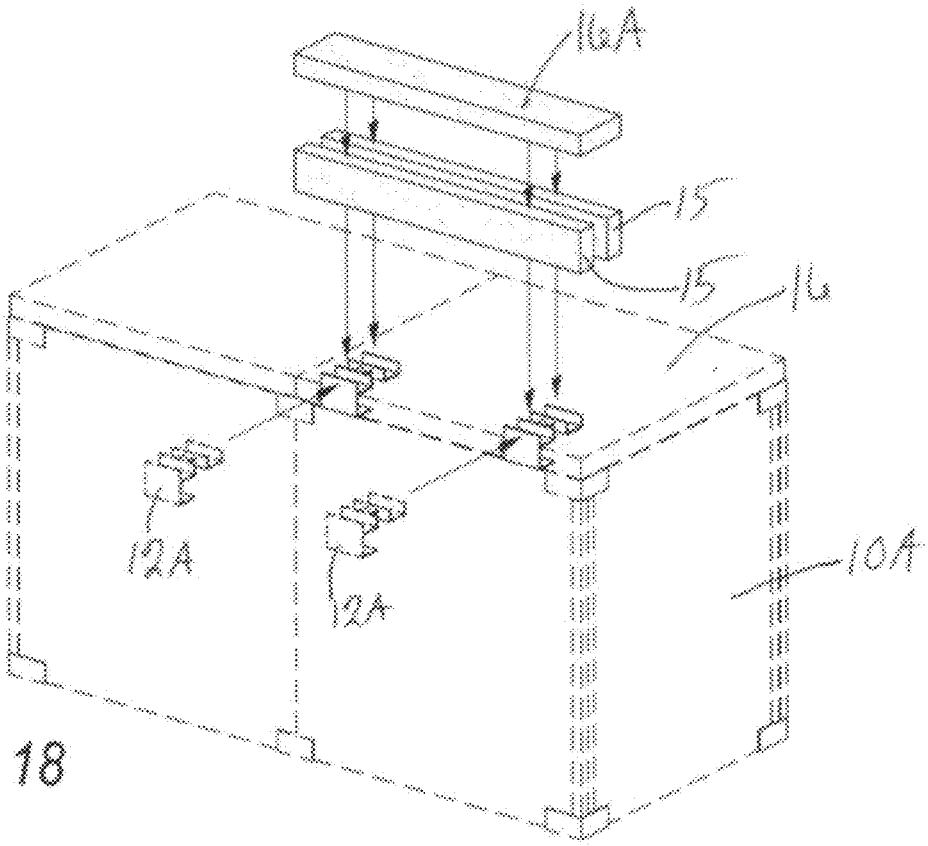
FIG. 18 a perspective view showing installation of a back splash unit onto a cabinet.
Figure 20:
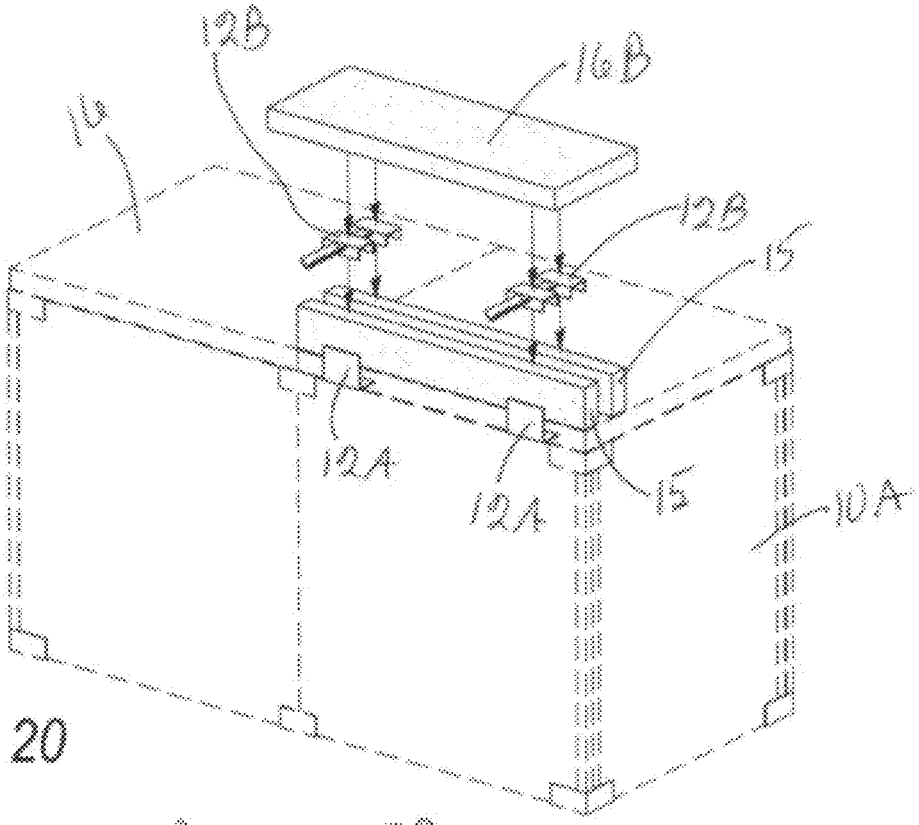
FIG. 20 a perspective view showing installation of a back bar unit onto a cabinet.

As shown in FIGS. 18 and 20, the accessory brackets 12A are hooked over the edge of the countertop 16 so that the lower lips 22 of the accessory brackets 12A are located between the countertop 16 and the upper edge of the side panels of the cabinet form 10A before the countertop 16 is glued to the cabinet form 10A. The countertop 16 is then glued to the cabinet form 10A, thereby securing the accessory brackets 12A in place, as shown in FIG. 18. Next, the back bar or back splash risers 15 are glued to the countertop 16 so that the risers 15 rest in upward facing channels 24 of the accessory brackets 12A.

Figure 19:
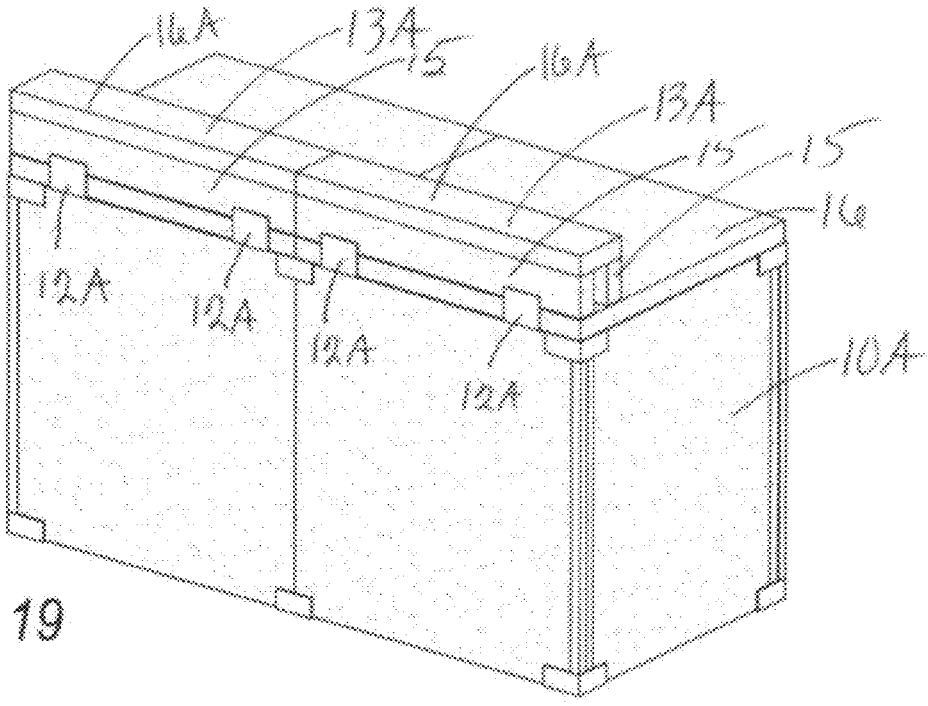
FIG. 19 a perspective view showing the back splash unit installed onto the cabinet.

At this point, if a back splash unit 13A is to be created, the back splash tops 16A are glued to the top edges of the risers 15, as illustrated in FIG. 19, to complete installation of the back splash unit 13A.

Figure 21:
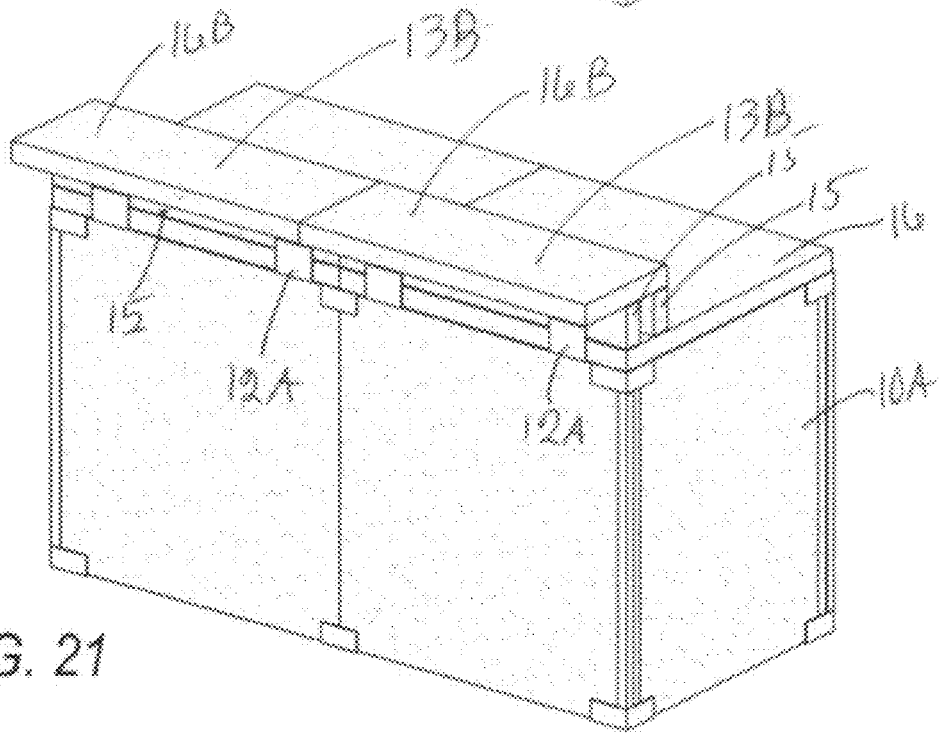
FIG. 21 a perspective view showing the back bar unit installed onto the cabinet.

Alternately, as illustrated in FIGS. 20 and 21, if a back bar unit 13B is to be created, back bar brackets 12B are secured to the tops of the risers 15 via downwardly facing channels 26 provided on the back bar brackets 12B, and the back bar tops 16B are glued to the top edges of the risers 15 to complete the back bar installation. Each of the back bar brackets 12B is provided with an arm 28 that extends under the back bar top 16B to help support and strengthen the back bar top 16B.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A cabinet component system for constructing a form for a cabinet comprising:

preformed lightweight concrete side panels;

a plurality of brackets securing the side panels together via corner edges of the side panels to create a form for a cabinet with the upper edges of the side panels accessible so that accessories can be attached thereto, each bracket having at least one channel for receiving the corner edges of at least two side panels as a means of securing the side panels together, two or more brackets of the plurality of brackets being provided with at least one support rod attached to the brackets and holding the brackets in a spaced apart arrangement;

accessory brackets secured to tops of the side panels between a cabinet top and the side panels;

risers securing to the accessory brackets and extending above the cabinet top; and a back splash top secured to the risers to form a back splash;

wherein the channels are selected from the following list of shapes: straight, 90 degree angle, and 135 degree angle.

2. A cabinet component system for constructing a form for a cabinet according to claim 1, wherein said concrete side panels are made from a cement mixture of cement, water and light weight aggregate.

3. A cabinet component system for constructing a form for a cabinet according to claim 2, wherein said cement mixture is comprised of approximately 1 part cement and 1 part water to 4 parts light weight aggregate.

4. A cabinet component system for constructing a form for a cabinet according to claim 3, wherein said aggregate is expanded shale.

5. A cabinet component system for constructing a form for a cabinet comprising:

preformed lightweight concrete side panels;

a plurality of brackets securing the side panels together via corner edges of the side panels to create a form for a cabinet with the upper edges of the side panels accessible so that accessories can be attached thereto, each bracket having at least one channel for receiving the corner edges of at least two side panels as a means of securing the side panels together, two or more brackets of the plurality of brackets being provided with at least one support rod attached to the brackets and holding the brackets in a spaced apart arrangement;

accessory brackets secured to tops of the side panels between a cabinet top and the side panels;

risers securing to the accessory brackets and extending above the cabinet top;

back bar brackets securing to top edges of the risers; and a back bar top secured to the risers and back bar brackets to form a back bar;

wherein the channels are selected from the following list of shapes: straight, 90 degree angle, and 135 degree angle.

6. A cabinet component system for constructing a form for a cabinet according to claim 5, wherein said concrete side panels are made from a cement mixture of cement, water and light weight aggregate.

7. A cabinet component system for constructing a form for a cabinet according to claim 6, wherein said cement mixture is comprised of approximately 1 part cement and 1 part water to 4 parts light weight aggregate.

8. A cabinet component system for constructing a form for a cabinet according to claim 7, wherein said aggregate is expanded shale.

* * * * *